US005193607A

United States Patent [19]

Demukai et al.

[11] Patent Number: 5,193,607

[45] Date of Patent: Mar. 16, 1993

[54] METHOD FOR PRECISION CASTING OF TITANIUM OR TITANIUM ALLOY

[75] Inventors: Noboru Demukai, Gifu; Shingo Hitotsuyanagi, Nagoya, both of Japan

[73] Assignee: Daido Tokushuko K.K., Nagoya, Japan

[21] Appl. No.: 934,910

[22] Filed: Aug. 26, 1992

Related U.S. Application Data

[63] Continuation of Ser. No. 699,834, May 14, 1991, abandoned.

[30] Foreign Application Priority Data

May 15, 1990 [JP] Japan ..... 2-124383

[51] Int. Cl.[5] ..... B22D 18/06; B22D 21/02

[52] U.S. Cl. ..... 164/493; 164/63; 164/66.1; 164/68.1; 164/255; 164/513

[58] Field of Search ..... 164/493, 513, 63, 255, 164/66.1, 68.1

[56] References Cited

U.S. PATENT DOCUMENTS 3,900,064 8/1975 Chandley et al. ..... 164/493
4,738,713 4/1988 Stickle et al. ..... 75/10.18
4,745,620 5/1988 Mortimer ..... 164/513 X
4,838,933 6/1989 Paillere et al. ..... 164/471
4,923,508 5/1990 Diehm et al. ..... 75/10.18 X
5,042,561 8/1991 Chandley ..... 164/63

FOREIGN PATENT DOCUMENTS 1-317673 12/1989 Japan ..... 164/63

*Primary Examiner*—J. Reed Batten, Jr.
*Attorney, Agent, or Firm*—Sughrue, Mion, Zinn, Macpeak & Seas

[57] ABSTRACT

Precision casting of titanium or titanium alloy includes establishing molten metal by induction heating in an assembly formed with water cooled copper segments disposed circlewise on the inside of an induction coil in a state insulated from each other and casting the molten metal into a permeable mold by vacuum casting. The precision casting method uses apparatus including an induction coil, an assembly formed with the aforementioned copper segments, an arrangement for feeding a base metal from the under side thereof and a permeable mold into which the molten base metal in the assembly is transferred by vacuum casting. It is possible to obtain precision castings of metal having high melting points and high actvitiy such as titanium, titanium alloy or the like.

4 Claims, 2 Drawing Sheets

METHOD FOR PRECISION CASTING OF TITANIUM OR TITANIUM ALLOY

This is a continuation of application Ser. No. 07/699,834 filed May 14, 1991 and now abandoned.

BACKGROUND OF THE INVENTION

1. Field of the Invention

This invention relates to a method for precision casting of titanium or titanium alloy applicable for obtaining precision castings of titanium or titanium alloy which are excellent in heat-resisting property and corrosion resistance in addition to their lightness, and which have very high strength.

2. Description of the Prior Art

Titanium and titanium alloy are light and excellent in heat and corrosion resistance and in mechanical strength. Therefore it is expected that useful products can be obtained by the precision casting of titanium or titanium alloy.

However, because the titanium or titanium alloy has a melting point higher than 1400° C. and is also active, there is a problem in that there are great difficulties in melting and casting the titanium or titanium alloy in the majority of cases.

Namely, when an ordinary ceramic crucible is used in order to melt the titanium or titanium alloy and obtain the quantity and temperature of the molten metal suitable for the casting, there is a problem in that oxide ceramics forming the crucible can be easily reduced by titanium at a high temperature. If a graphite crucible is used, there is another problem in that it is only possible to carry out the melting in a small quantity for a short time from a standpoint of preventing the titanium or titanium alloy fron contamination because carbon dissolves into the titanium or titanium alloy. In regard to a mold for casting the molten metal of the titanium or titanium alloy thereinto, a reaction sometimes takes place between the mold and the molten metal. In this case, it is necessary to reduce the casting temperature as much as possible, however the molten metal is apt to solidify before the mold cavity is filled sufficiently with the molten metal in such a case and there is a different problem in that a misrun of the molten metal is caused in precision castings having thin-walled and complicated shapes.

SUMMARY OF THE INVENTION

This invention is directed to solving the above-mentioned problems of the prior art, and an object of the invention is to provide a method and an apparatus for precision casting which make it possible to obtain precision castings of metals with high melting points or high activity by preventing the molten metal from contamination in the melting, maintaining the quantity and the temperature of the molten metal required for the casting, and casting the molten metal under a forced casting condition suitable to prevent a misrun of the molten metal even if the molten metal is cast at a low temperature at the time of carrying out the precision casting of titanium, titanium alloy or other metals having high melting points or high activities such as tungsten, molybdenum, vanadium, zirconium, lithium or the like.

The method for precision casting of titanium or titanium alloy according to this invention for attaining the above-mentioned object is characterized by comprising the steps of establishing molten base metal of titanium or titanium alloy by induction heating in an assembly formed with a plurality of water cooled copper segments disposed circlewise on the inside of an induction heating coil in a state in which the copper segments are insulated from each other, and casting the molten base metal into a permeable mold disposed above the molten base metal by vacuum casting. In preferred aspects according to this invention, the base metal may be molten in an atomosphere of an inert gas such as argon and may be cast into the permeable mold through a tubular sprue, and the base metal of titanium or titanium alloy may be fed continuously into the assembly formed with the water cooled segments from the under side of the assembly.

The construction of the precision casting apparatus for titanium or titanium alloy according to this invention for attaining the above-mentioned object is characterized by comprising an induction heating coil, an assembly formed with a plurality of water cooled copper segments disposed circlewise on the inside of the induction heating coil in a state in which the copper segments are insulated from each other, and fed with base metal of titanium or titanium alloy from the under side thereof, and a permeable mold for casting the base metal molten by induction heating on the inside of the assembly formed with the water cooled copper segments by means of vacuum casting. In the preferred aspects according to this invention, the permeable mold may be provided with a plurality of tubular sprues for conducting the molten base metal thereinto at the time of vacuum casting and a closed feeder head in the upper part thereof, and the permeable mold may be a ceramic shell mold.

DETAILED DESCRIPTION OF THE INVENTION

In the method and the apparatus for precision casting of titanium or titanium alloy according to this invention having the aforementioned construction, eddy currents are formed on the inside of the assembly formed with water cooled copper segments disposed circlewise on the inside of the induction coil and insulated from each other at the time of melting the base metal of titanium or titanium alloy in the assembly formed with the water cooled copper segments.

Therefore, the base metal is molten by an eddy current induced in the outer layer thereof by the above-mentioned eddy currents which are alternating currents, in this time the molten base metal is detached from the assembly formed with the water cooled copper segments by repelling force caused by currents flowing in the outermost layers of the assembly and the molten metal and having opposite phases each other, and a gap is formed between the molten metal and the inner periphery of the assembly.

Accordingly, thermal transmission from the molten metal to the assembly is suppressed by the formation of the gap, a thick-walled skull (a layer of solidified metal) is scarcely formed differing from the cases of conventional furnaces of a water cooled hearth type such as an arc skull crucible furnace and so on, for example, and the base metal is molten in a better yield. It is easy to regulate the temperature of molten metal by controlling electric energy to be supplied to the induction coil, the molten base metal is not contaminated substantially because a ceramic crucible composed of oxides is not used, and precision castings of good quality can be obtained.

DESCRIPTION OF THE PREFERRED EMBODIMENT

Figure 1:
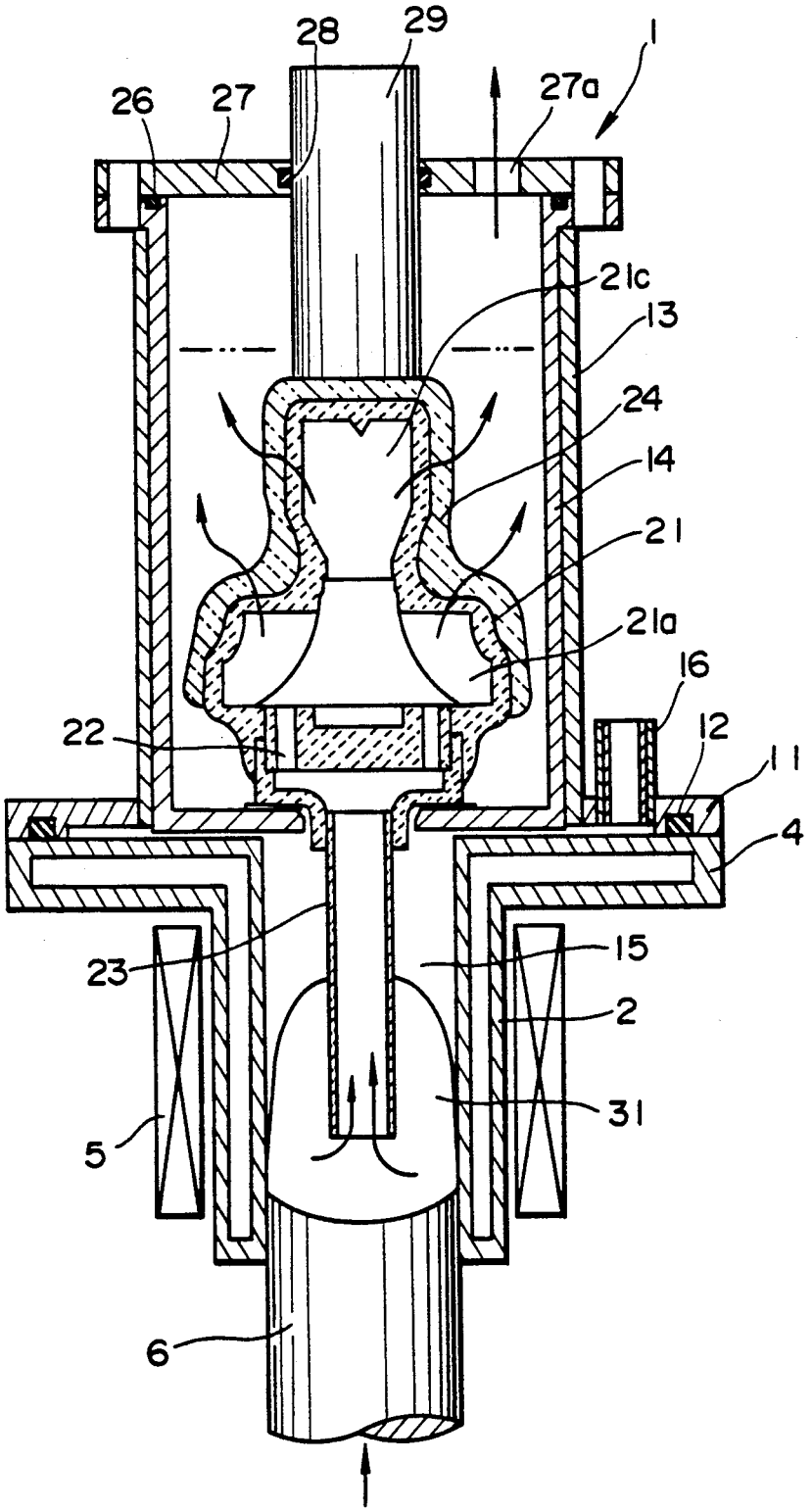
FIG. 1 is a vertical sectional side view illustrating the precision casting apparatus according to an embodiment of this invention.
Figure 2:
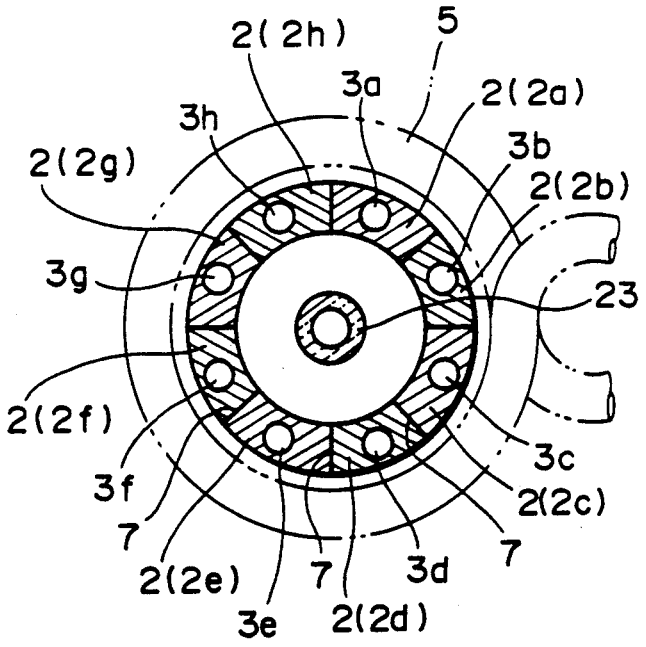
FIG. 2 is a horizontal sectional view of the assemble formed with the water cooled copper segments in the precision casting apparatus shown in FIG. 1.

A precision casting apparatus which is used in an embodiment of the method for precision casting of titanium or titanium alloy according to this invention is shown in FIG. 1 and FIG. 2. The precision casting apparatus 1 is provided with an assembly 2 in the center part thereof which is formed with a plurality of water cooled copper segments 2*a*, 2*b*, . . . 2*h* disposed circlewise while being insulated from each other through insulations 7, and the respective water cooled copper segments 2*a*, 2*b*, . . . 2*h* are provided with water pipes 3*a*, 3*b*, . . . 3*h*. The assembly 2 is provided continuously with a magnetic shield 4 on the upper side thereof.

The assembly 2 is disposed with a radio-frequency induction coil 5 on the outside thereof and so designed as to feed base metal 6 of titanium or titanium alloy on the inside from under side thereof.

The magnetic shield 4 is provided with a circular base 11 through a seal 12 on the upper side thereof and provided with a sleeve 13 on the inside of the circular base 11, and a mold chamber 14 is provided on the inside of the sleeve 13. Melting space 15 is formed in a part surrounded by the bottom face of the mold chamber 14 and inner peripheries of the assembly 2 and the magnetic shield 4, and it is possible to replace the atomosphere in the melting space 15 with an inert gas by supplying argon through a gas intake 16 provided on the circular base 11, for example.

A permeable mold 21 which is a ceramic shell mold is disposed in the mold chamber 14, and a turbine wheel-shaped mold cavity 21*a* in the permeable mold 21 and the melting space 15 are connected by a gate 22 formed in the permeable mold 21 and a tubular sprue 23 communicating to the gate 22.

The permeable mold 21 is provided with a closed feeder head 21*c* in the upper part thereof, and disposed with a heat insulator 24 having gas permeability on the outer surface thereof.

Further, the mold chamber 14 is provided with an upper plate 27 through a seal 26 on the upper end thereof and the permeable mold 21 is held with a support 29 piercing the upper plate 27 through a seal 28, and the upper plate 27 is provided with a suction hole 27*a*.

Therefore, in the precision casting apparatus 1 acording to this embodiment which is provided with the assembly 2 on the inside of the radio-frequency induction coil 5 as described above, eddy currents are formed on the inside of the assembly 2 by radio frequency induction of the radio-frequency induction coil 5, and the base metal 6 of titanium or titanium alloy is rendered molten by an eddy current induced in the outer layer of the base metal 6 by the eddy currents which are alternating currents. At this time the molten metal 31 of titanium or titanium alloy is slightly separated from the inner periphery of the assembly 2 by repelling force caused by currents flowing in the outermost layers of the assembly 2 and the molten metal 31 and having opposite phases each other, and a gap is formed between the molten metal 31 and the assembly 2.

Accordingly, thermal transmission from the molten metal 31 of titanium or titanium alloy to the assembly 2 is suppressed by the formation of the gap. Thereby, a thick-walled skull which is formed in conventional furnaces of a water cooled hearth type such as an arc skull crucible furnace and so on is scarely formed, and it becomes possible to melt the base metal 6 of titanium or titanium alloy with a better yield. It becomes possible to regulate the temperature of the molten metal 31 of titanium or titanium alloy easily by controlling electric energy to be supplied to the radio-frequency induction coil 5. Furthermore, there is no contamination of the molten metal 31 practically since a ceramic crucible composed of oxides is not used.

By reducing the pressure in this state through the suction hole 27*a* provided in the upper plate 27, gas existing in the mold cavity 21*a* and the feeder head 21*c* of the permeable mold 21 is discharged in the mold chamber 14 passing through the permeable mold 21 as shown with arrows according to the difference of internal pressures between the mold chamber 14 and the melting space 15, whereby the molten metal 31 of titanium or titanium alloy is sucked and cast into the mold cavity 21*a* through the tubular sprue 23 and the gate 22. At this time, the molten metal 31 is drawn by suction up to the feeder head 21*c* and is prepared for shrinkage cavity accompanied with solidification shrinkage of the molten metal 31 of titanium or titanium alloy in the mold cavity 21*a*.

A cast product is obtained by shakeout after the solidification of the molten metal 31 in the permeable mold 21.

In this embodiment, Ti-Al intermetallic compound which is light and excellent in mechanical strength at high temperature was chosen as base metal 6 of titanium or titanium alloy, and cast into a turbine wheel for turbo charger which is 1200 g in finished weight with outside diameter of 140 mm.

The high-frequency generator used for supplying high frequency wave to the induction heating coil 5 is a small and simplified type comparatively having capacity of 60 kW. The frequency is high as much as 30 kHz, so that it is possible to melt materials with small diameters efficiently.

The turbine wheel has twelve turbine blades and twelve gates 22 having diameters of 8 mm were provided near the lower parts of respective turbine blades in total.

The base metal 6 composed of Ti-Al intermetallic compound was fed from the under side of the assembly 2 formed with water cooled copper segments 2*a*, 2*b*, . . . 2*h*, and heated by supplying the high frequency wave of 60 kW with frequency of 30 kHz to the induction heating coil 5. The base metal 6 was rendered molten by forming eddy currents on the inside of the assembly 2 and inducing an eddy current in the outermost layer of the base metal 6 of Ti-Al alloy.

The casting temperature was determined at 1580° C. by making the temperature of the molten metal 31 higher than the melting point 1520° C. of the Ti-Al alloy by 60° C. (superheat).

The degree of superheat in this time is remarkably low as compared with that of the top poured conventional precision casting (150°~250° C.), it is effective for inhibiting the reaction between the permeable mold 21 and the molten metal 31.

By reducing the pressure at the aforementioned casting temperature by pressure of 350 mm Hg or so through the suction hole 27*a*, the gas in the mold cavity 21*a* was discharged through the permeable mold 21 according to the difference of the internal pressures between the mold chamber 14 and the melting space 15, and the molten metal 31 of Ti-Al alloy was drawn by suction in the mold cavity 21*a* and the feeder head 21*c* through the tubular sprue 23 and the gates 22. Then the turbine wheel was obtained by solidifying the molten metal 31 in the mold cavity 21*a*.

At this time, as the molten metal 31 was drawn in the mold cavity 21*a* by vacuum casting, the molten metal 31 spreads well into every nook and corner of the thin-walled turbine blade, and it was possible to obtain the turbine wheel with high accuracy in shape.

By using the method and the apparatus for precision casting according to this invention, it becomes possible to manufacture complicated and large-sized precision castings which were previously impossible and the invention will contribute much to further development of the precision casting of titanium or titanium alloy. In addition to above, it is possible to apply the method and the apparatus to precision casting of metals or alloys of the metals having high melting points or high activity such as tungsten, molybdenum, vanadium, zirconium, lithium or the like.

As mentioned above, the method for precision casting of titanium or titanium alloy according to this invention comprises the the step of establishing molten base metal of titanium or titanium alloy by induction heating in an assembly formed with a plurality of water cooled copper segments disposed circlewise on the inside of an induction heating coil in a state in which the copper segments are insulated from each other, and casting the molten base metal into a premeable mold disposed above the molten base metal by vacuum casting. Therefore, the molten base metal is detached from the assembly and a gap is formed between the molten metal and the assembly by repelling force caused by currents flowing in the outermost layers of the assembly and the molten metal and having opposite phases relative to each other because the base metal is molten by an eddy current induced in the outer layer thereof by eddy currents which are alternaing currents at the time of melting the base metal of titanium or titanium alloy. Excellent effects can be obtained in that the yield rate of the base metal is improved remarkably, the control of the temperature of the molten metal is facilitated, it is possible to prevent the molten metal from the contamination and possible to obtain the precision casting of good quality because the thermal transmission from the molten metal to the assembly is suppressed and the solidified metal layer becomes not to be formed between the molten metal and the assembly.

The precision casting apparatus for titanium or titanium alloy according to this invention comprises an induction heating coil, an assembly formed with a plurality of water cooled copper segments disposed circlewise on the inside of said induction heating coil in a state in which the copper segments are insulated from each other, and fed with base metal of titanium or titanium alloy from the under side thereof, and a permeable mold for casting the base metal molten by induction heating on the inside of the assembly formed with the water cooled copper segments by means of vacuum casting. Therefore, an excellent effect can be obtained since it becomes possible to manufacture the precision castings of titanium or titanium alloy with accuracy in a better yield by enabling execution of the aforementioned method for precision casting of titanium or titanium alloy.

What is claimed is:

1. A method for precision casting of titanium or titanium alloy which comprises:

continuously feeding base metal of titanium or titanium alloy upwardly into an open bottom crucible formed from a plurality of water cooled copper segments disposed in a circle inwardly of an induction heating coil with said copper segments being insulated from each other;

inductively heating said base metal of titanium or titanium alloy in the crucible to provide molten base metal; and casting said molten base metal into a permeable mold disposed above the molten base metal by vacuum casting.

2. A method for precision casting of titanium or titanium alloy as claimed in claim 1, further comprising providing an atmosphere of inert gas in said crucible in contact with said molten base metal.

3. A method for precision casting of titanium or titanium alloy as claimed in claim 1, further comprising casting said molten base metal of titanium or titanium alloy into the permeable mold through a tubular sprue.

4. A method for precision casting of titanium or titanium alloy as claimed in claim 2, further comprising casting said molten base metal of titanium or titanium alloy into the permeable mold through a tubular sprue.

* * * * *